US008720137B2

(12) United States Patent
Love

(10) Patent No.: US 8,720,137 B2
(45) Date of Patent: May 13, 2014

(54) KE ARCHITECTURAL ELEMENT

(71) Applicant: Stanley Gene Love, Oak Point, TX (US)

(72) Inventor: Stanley Gene Love, Oak Point, TX (US)

( * ) Notice: Subject to any disclaimer, the term of this patent is extended or adjusted under 35 U.S.C. 154(b) by 0 days.

(21) Appl. No.: 13/651,861

(22) Filed: Oct. 15, 2012

(65) Prior Publication Data

US 2014/0102019 A1 Apr. 17, 2014

(51) Int. Cl.

| | |
|---|---|
| ***E04H 1/00*** | (2006.01) |
| ***E04C 2/52*** | (2006.01) |
| ***E04H 12/00*** | (2006.01) |
| ***E04H 3/00*** | (2006.01) |

(52) U.S. Cl.

USPC ..... 52/220.1; 52/79.4; 52/648.1; 52/653.1

(58) Field of Classification Search

USPC ..... 52/79.1, 79.4, 650.3, 220.1, 648.1, 52/653.1; D25/61

See application file for complete search history.

(56) References Cited

U.S. PATENT DOCUMENTS

| | | | | |
|---|---|---|---|---|
| 3,694,973 | A * | 10/1972 | Unger | 52/34 |
| 3,906,686 | A * | 9/1975 | Dillon | 52/79.9 |
| 4,655,011 | A * | 4/1987 | Borges | 52/79.1 |
| 5,076,310 | A * | 12/1991 | Barenburg | 137/15.08 |
| 5,467,562 | A * | 11/1995 | Holland | 52/79.1 |
| 6,688,048 | B2 * | 2/2004 | Staschik | 52/79.1 |
| 7,320,200 | B1 * | 1/2008 | Eisner | 52/236.1 |
| 8,047,467 | B2 * | 11/2011 | Erickson et al. | 244/118.1 |
| 2002/0189173 | A1 * | 12/2002 | Staschik | 52/79.1 |
| 2006/0185266 | A1 * | 8/2006 | O'Callaghan et al. | 52/79.1 |
| 2010/0229472 | A1 * | 9/2010 | Malpas | 52/79.1 |
| 2011/0099918 | A1 * | 5/2011 | Buchmann | 52/79.1 |
| 2011/0179721 | A1 * | 7/2011 | Barry et al. | 52/79.1 |
| 2011/0296778 | A1 * | 12/2011 | Collins et al. | 52/220.1 |
| 2013/0014451 | A1 * | 1/2013 | Russell et al. | 52/79.1 |

* cited by examiner

*Primary Examiner* — Ryan Kwiecinski

(57) ABSTRACT

The KE architectural element is a component of a building or space.

Designed by a licensed architect, interior designer, and general contractor, the KE architectural element will revolutionize the creative design approach to space planning of interiors. Used as a template tool, the KE architectural element will influence the arrangement of spaces. The KE architectural element will result in the efficient, effective, and sustainable solution of any project. The KE architectural element is formed out of standard metal framing parts and can fit any actual condition. Easy to assemble, the KE architectural element will be the central hub for all utility infrastructures, which is housed in compartments and distributed within zoned layers according to specified locations. The KE architectural element will adapt to a number of standard configurations of plumbing fixture, appliance, and cabinetry layouts. The KE architectural element comes in a single key shape that is adaptable to varied dimensional restraints, depending upon the ultimate use and design intent for the space.

1 Claim, 9 Drawing Sheets

KE ARCHITECTURAL ELEMENT

BACKGROUND OF THE INVENTION

Fields of Endeavor to which the Invention pertains—Architecture, interior design, and the building industry The KE architectural element combines all standard mechanical, electrical, plumbing, and technology systems into a single architectural element which, by placement, forms interior room spaces in both residential and commercial living/working environments. A unique "key shape" is the mounting surface for an array of fixtures, appliances, and cabinetry used in both new and renovated conditions.

The KE architectural element is an efficient, effective, flexible, and sustainable approach to the design and construction of interior spaces. The KE architectural element promotes (a) efficient space utilization, (b) effective distribution of utility infrastructure, (c) flexibility, and (d) sustainable use of resources and energy.

The KE architectural element is an assembly of noncombustible lightweight metal stud framing and formed sheet metalwork, which are dimensionally adaptable to fit most conditions. The architectural element is boxed and shipped as a kit to any location.

BRIEF SUMMARY OF THE INVENTION

The objective of this invention is to create a universal design approach when addressing the layout of interior spaces of a structure or project. The design of a single architectural element becomes the new standard in space planning. The unique "key shape" geometry acts as the template to be used during the design phase. The KE architectural element is dimensionally adaptable to form and define interior space both in new and renovated conditions. As a result, optimum space utilization is accomplished through an efficient design.

The KE architectural element provides an effective distribution of utility infrastructure by supporting the installation and routing of (a) heating, ventilation, and air conditioning units, (b) tank or tankless hot water units, (c) plumbing fixtures, (d) electrical power load centers and wiring, (e) security system, (f) technology, (g) sound and communications systems, and (h) others. Integral cavity space is compartmentalized to organize the delivery of the above systems from source to individual device locations. All or a part of these devices can be located within the KE architectural element.

A sustainable use of resources practice is reinforced through a decrease in the amount of material, time, and energy expended in the compact nature of this concept. The material length of piping, ducting, and wiring is reduced throughout the interior space design. The reduction in the amount of material used and time spent roughing-in these utilities accelerate the construction schedule, resulting in a cost savings to the overall project. The installation of HVAC equipment and associated ductwork in a conditioned space reduces the amount of energy required to re-condition the air resting within and results in lower operating expense. Designers and builders alike use the KE architectural element to mold and model a sustainable approach to 21$^{st}$ Century interior space design.

DETAILED DESCRIPTION OF THE INVENTION

The detailed description of the process of making this invention begins with the unpacking of a box containing the kit of parts, a collection of standard materials widely used throughout the design and construction industry. Included are:

- Lightweight C-shape metal studs 1 and tracks 2—
  - Precut to length depending upon the required model framing dimensions
  - Pre-drilled pilot holes for precise alignment and placement of each part
  - Pre-labeled with a part number referenced in the KE architectural element
  - Instructions to Assembly
- Formed sheet metal liner pan/trays 3—
  - Sheet metal roll stock liner pan/tray parts are cut, bent, and seamed to fit
  - Pre-drilled pilot holes for precise alignment and placement of each part
- Fire-treated plywood mechanical platform inserts 4—
  - Pre-sized ¾ material for mechanical/plumbing equipment compartments
  - Field cut-out based upon vertical HVAC unit return air requirement
- Self-tapping screws and a complimentary screwdriver
  - Only fasteners and tool required for quick assembly Detailed assembly instructions for the model length requested, basic (12', 14', or 16') or custom, will guide the installation of this unique architectural element. The assembly of these parts requires someone to carefully mark the designed location on the floor and mirror that same location on the ceiling. A dimensioned plan layout (FIG. 3, FIG. 5) will be included in the KE architectural element Instructions to Assembly.

Figure 1:
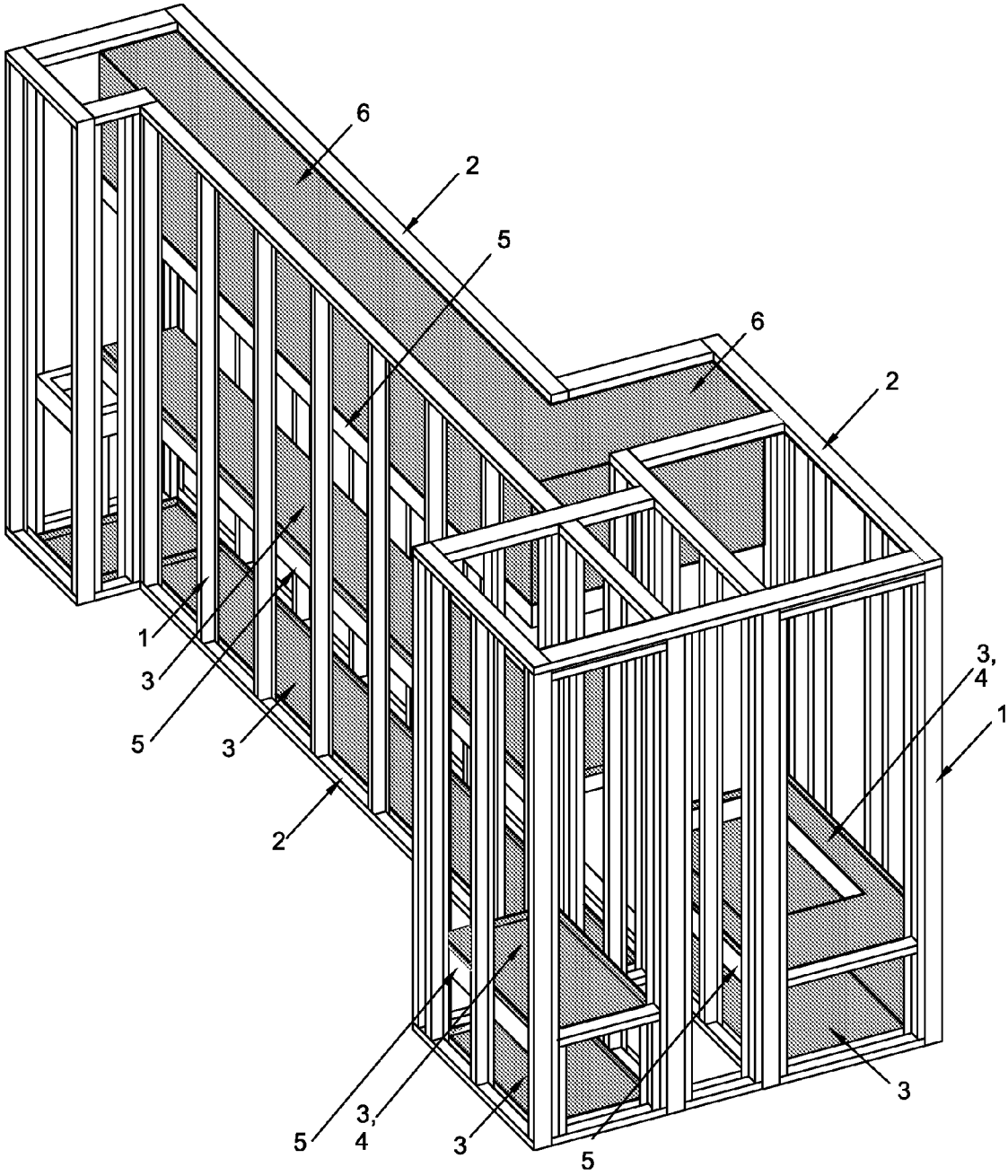
FIG. 1 Axonometric View—Overall 3D view
FIG. 2 Kitchen+Bath Conceptual Space Plan
FIG. 3 Kitchen and Bath Plan FIG. 4 Bed+Bath Conceptual Space Plan
FIG. 5 Bed and Bath Plan
FIG. 6 Elevation
FIG. 7 Elevation
FIG. 8 Elevation
FIG. 9 Elevation
FIG. 10 Detail Section
Figure 2:
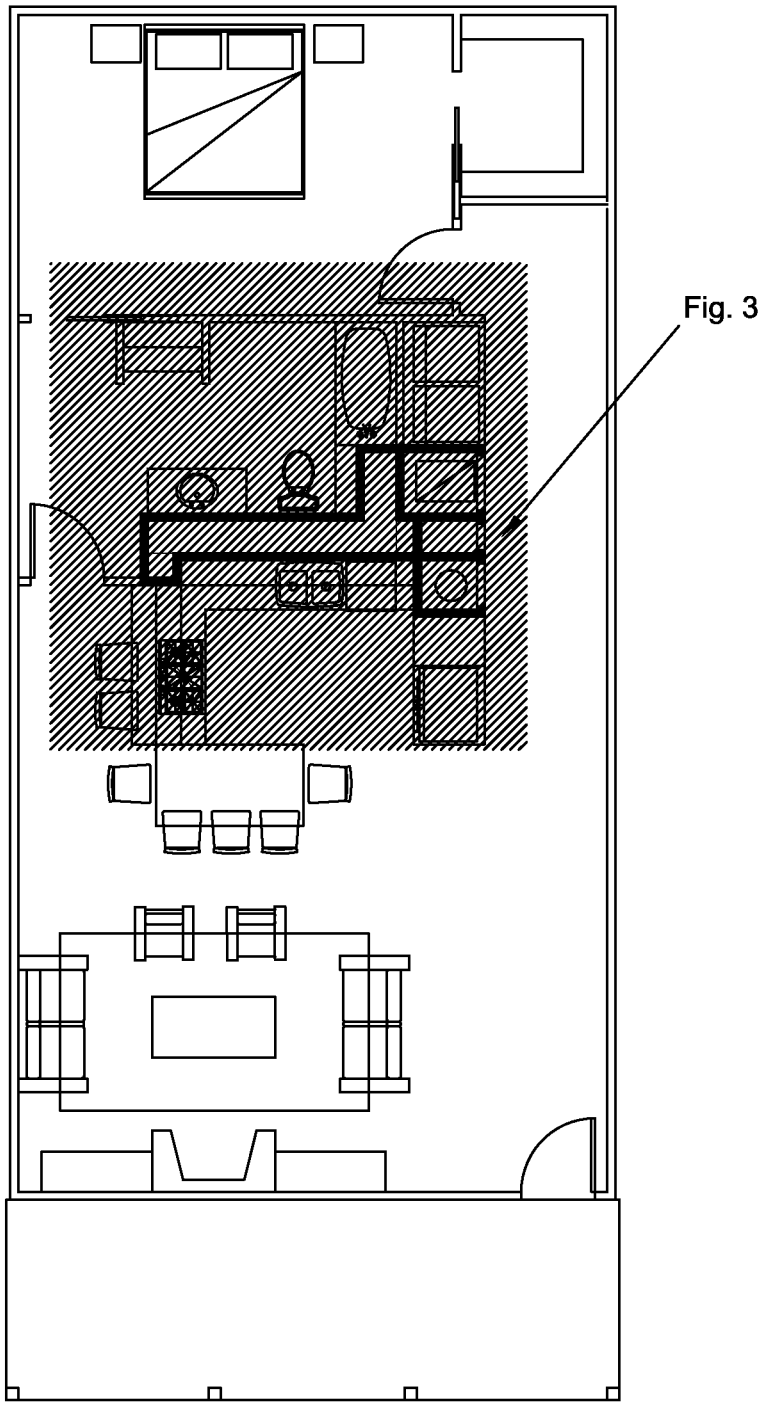

The conditions may vary depending upon whether the KE architectural element is to be used in new construction or the renovation of an existing space. These marked locations will guide the installation of metal tracks 2 and metal liner pans 3, followed by vertical C-shaped metal studs 1 to complete the wall framing step. Horizontal tracks 5 are rotated and screw-fastened to become supports for metal liner trays 3, HVAC metal supply duct 6, and fire-rated plywood platform inserts 4 at the HVAC 7 and hot water heater 8 compartments (FIG. 6, FIG. 7, FIG. 8, and FIG. 9). Once the horizontal tracks 5, along with their trays 3, duct 6, and platform inserts 4 are in place, the KE architectural element is ready to accept utilities and equipment by other trades people (FIG. 1).

Figure 3:
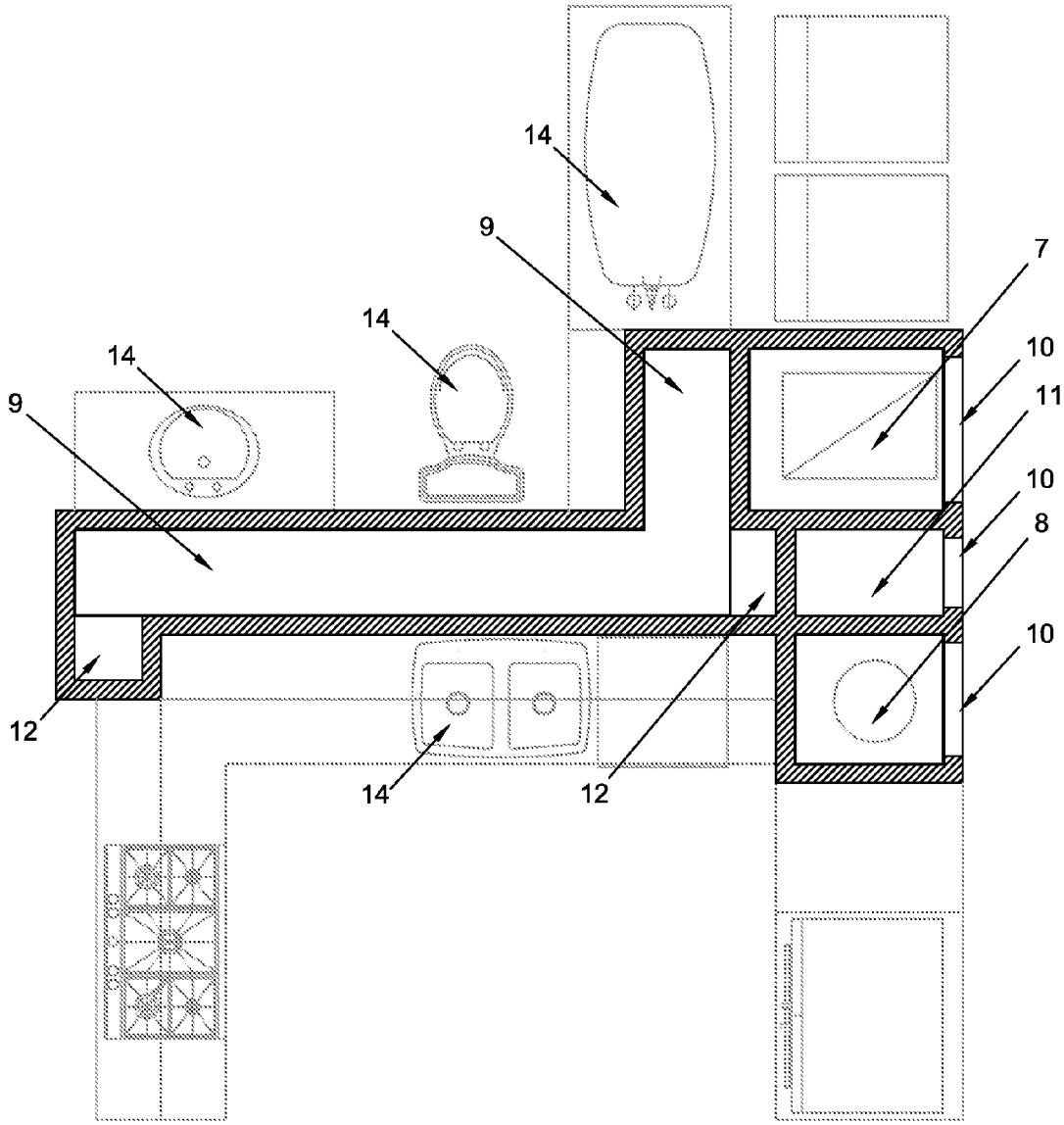
Figure 4:
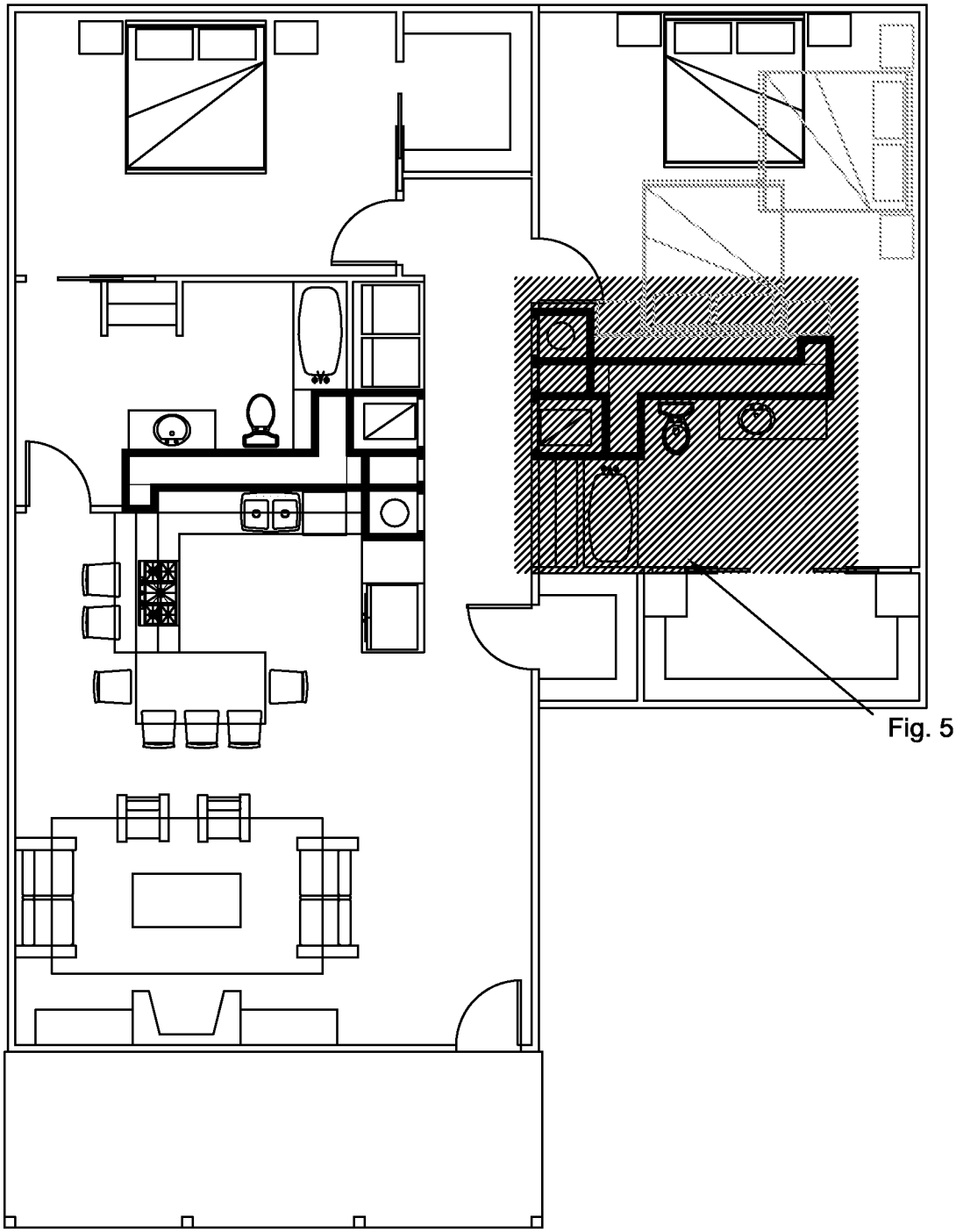
Figure 5:
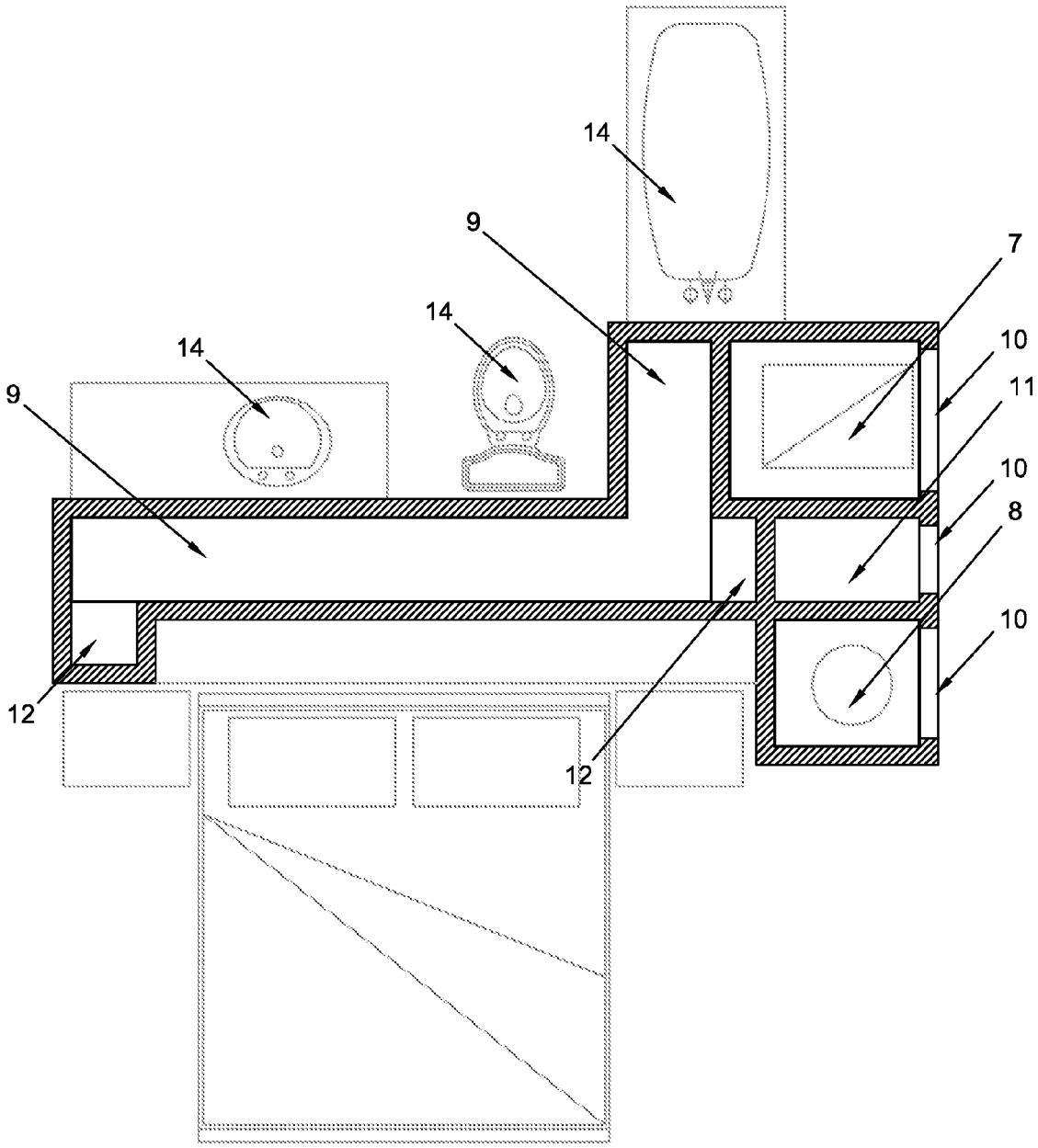
Figure 6:
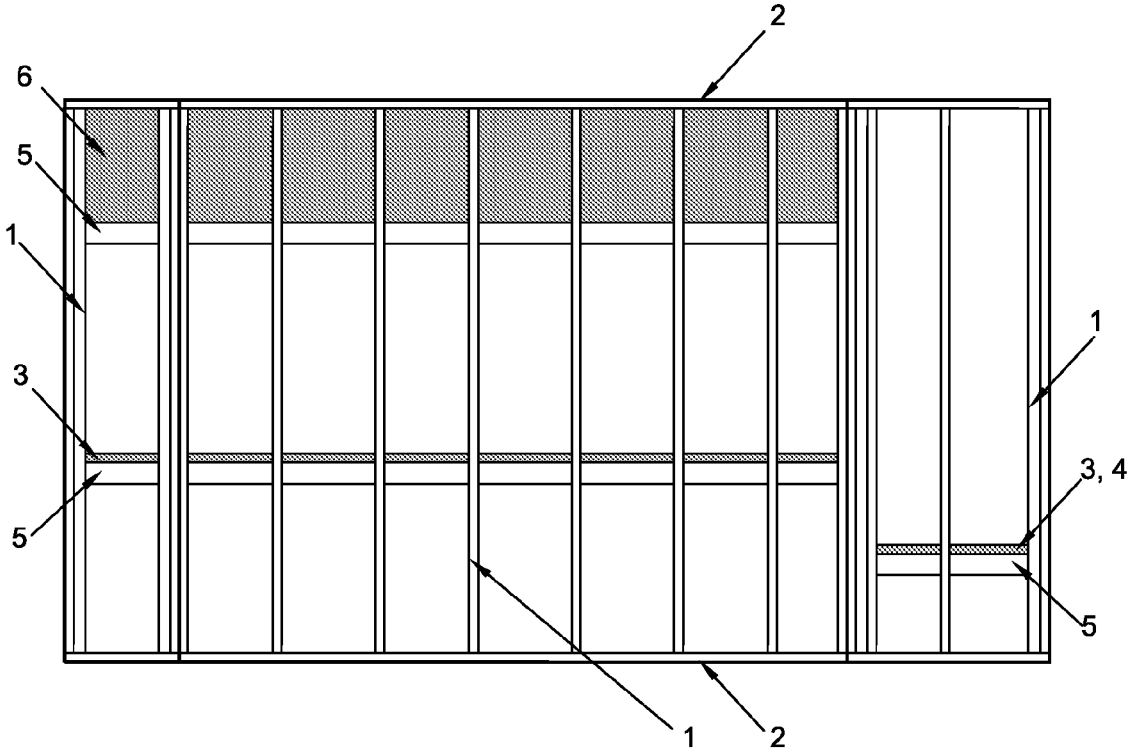
Figure 7:
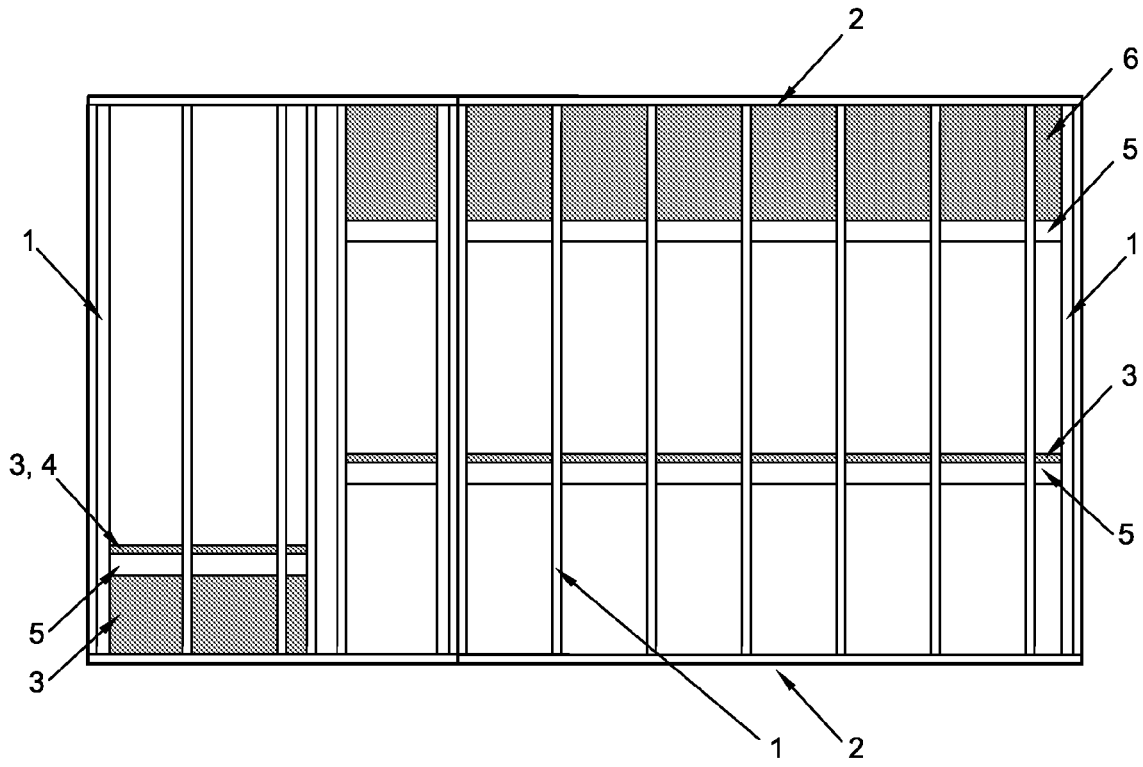
Figure 8:
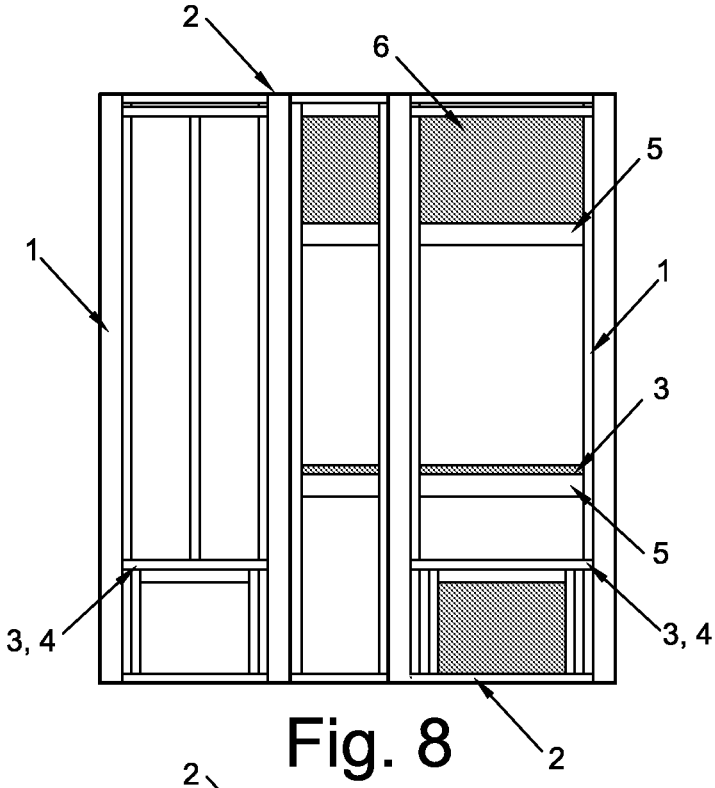
Figure 9:
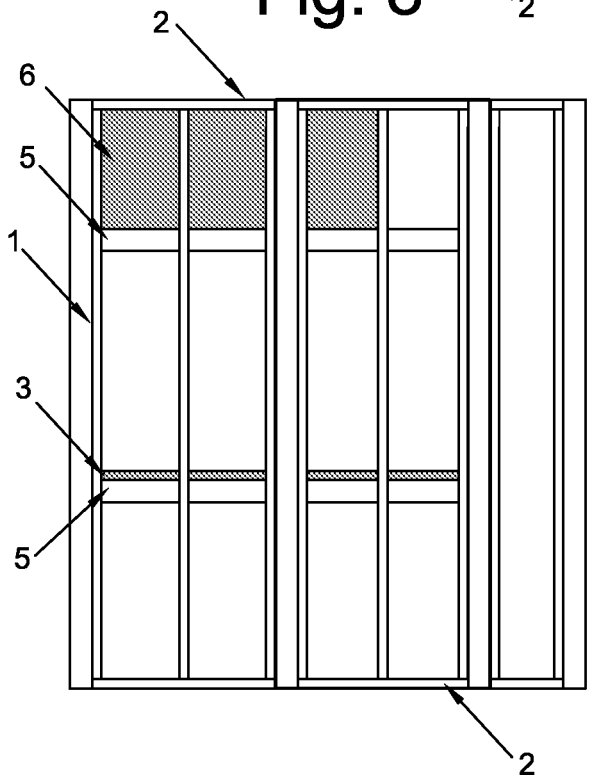
Figure 10:
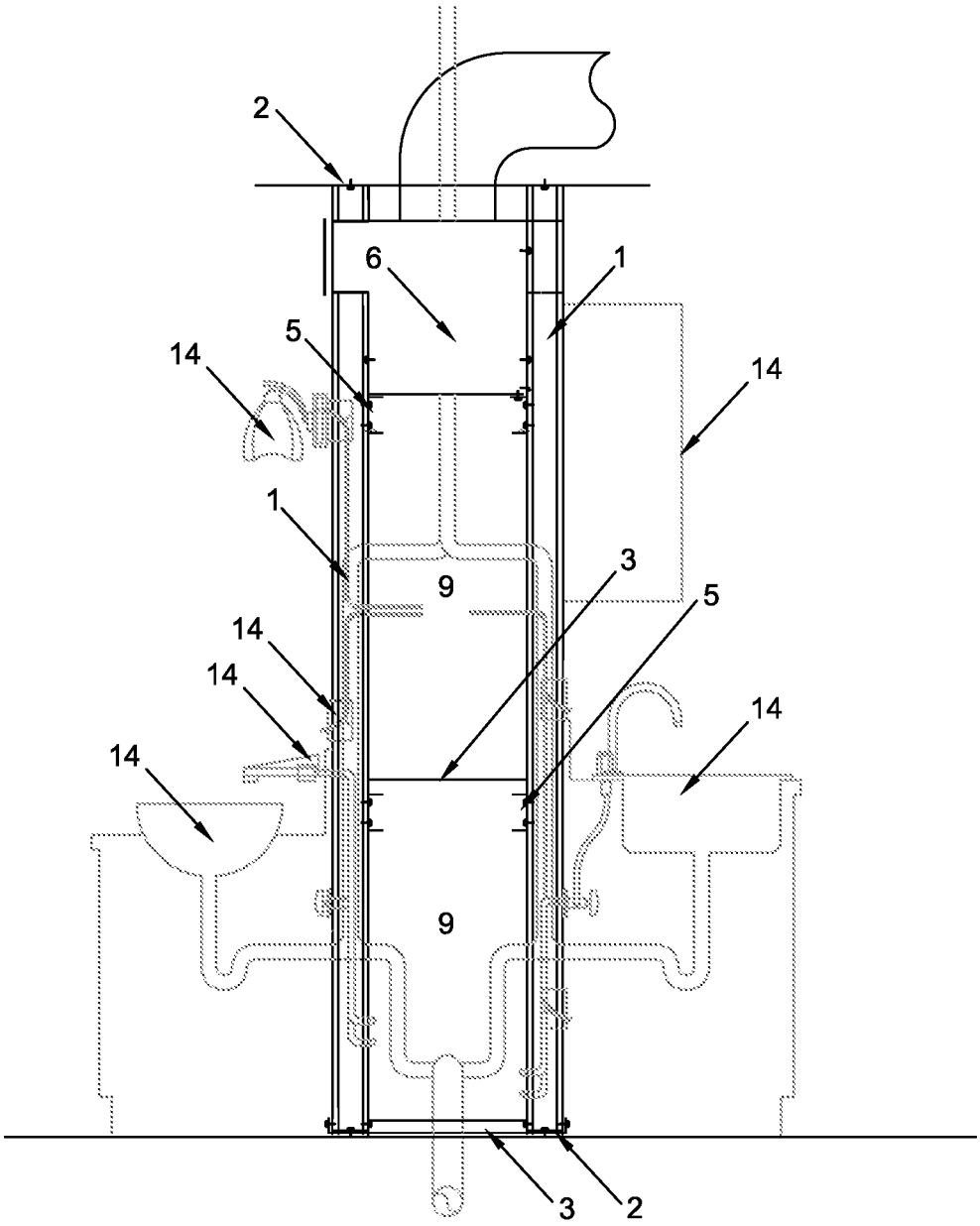

The detailed description of the implementation of this invention requires an understanding of the basic components that make up the KE architectural element (FIG. 3, FIG. 5 and FIG. 10)

- HVAC air handling unit compartment 7—
  - Sized to accept an upright vertical flow air handling unit furnished and installed by other trades people
  - Opening 10 provided to receive door/frame by other trades people (equipment access)

HVAC metal supply duct 6—

A formed sheet metal supply duct, lined with insulation, will satisfy most HVAC unit air flow requirements. The size will be specified by the purchaser prior to manufacturing. Supporting track guides 5 will be adjusted to fit the dimension needed Mechanical and electrical horizontal chase 9—

Volumes of layered space captured to zone and route mechanical HVAC Ductwork, open return air, plumbing supply and waste lines, gas piping, technology cabling, and electrical wiring Hot water heater compartment 8—

Sized to accept either a tank or tankless hot water heating unit furnished and installed by other trades people Opening 10 provided to receive door/frame by other trades people (equipment access)

Access opening 10—

Location provided for access to utility rough-in core/chase and mechanical/electrical horizontal chases Utility rough-in core/chase 11—

Rough-in location for all incoming and returning utilities (from above the ceiling and/or below the floor/foundation)

Single source location

Vertical mechanical chase 12—

Two (2) locations provided for vertical venting of waste water plumbing, gas vent pipes, exhaust and dryer vent ducting, etc. (from above the ceiling and/or through the roof)

Return air grille locations 13—

Multiple locations provided

Room Fixtures 14—(by other trades people)

Wall mounting surface support for the installation of plumbing and electrical fixtures, custom cabinetry, etc. (FIG. 10)

I claim:

1. An architectural element for centralizing the location of core utility systems in the design and construction of interior space environments wherein said architectural element is assembled in situ and forms a space defining an elongated shape, said shape defined by a horizontal cross section having an elongated central rectangular portion having a first end portion and a second end portion, wherein said first end portion projects perpendicular to said central portion in a first direction and said second end portion projects perpendicular to said central portion in the first direction and in a second direction opposite the first direction, wherein said first end portion is parallel to said second end portion, said architectural element comprising:

a structural frame, said structural frame comprising:

a plurality of lightweight C-shape horizontal top and bottom metal tracks having pre-drilled pilot holes;

a plurality of pre-cut lightweight vertical C-shape metal studs having pre-drilled pilot holes wherein said pre-drilled pilot holes of said plurality of metal studs are aligned with said pre-drilled pilot holes of said plurality of top and bottom metal tracks and fastened using self-tapping screws forming said structural frame, said structural frame forming said elongated shape;

wherein said structural frame is formed with access openings for residential or commercial environments and is capable of receiving interior wall finishing materials;

a plurality of supporting C-shape horizontal metal track guides having pre-drilled pilot holes wherein said supporting metal track guides are fastened to said plurality of vertical metal studs about 36" above said plurality of bottom tracks by self-tapping screws through said pre-drilled pilot holes;

fire-treated plywood platform insert sheets having a thickness of about ¾" placed on top of said plurality of track guides forming a heating, ventilation, and air conditioning (HVAC) mechanical equipment compartment plenum base having a pre-determined cut-out and a hot water heating equipment compartment base;

a plurality of horizontal sheet metal liner trays having pre-drilled pilot holes, wherein said plurality of liner trays are placed between said plurality of bottom tracks, on top of said plurality of track guides, and on top of said platform insert sheets, wherein said plurality of metal liner trays are fastened by self-tapping screws;

a preformed insulated sheet metal HVAC supply duct having a pre-determined size to fit within said architectural element placed on said plurality of track guides, said duct having openings for air distribution.

* * * * *